US008827490B2

(12) United States Patent
Kim et al.

(10) Patent No.: US 8,827,490 B2
(45) Date of Patent: Sep. 9, 2014

(54) LIGHTING APPARATUS

(75) Inventors: Kyunghyun Kim, Seoul (KR); Minkwang Lee, Seoul (KR); Ana Kim, Seoul (KR); Myoungwoo Lee, Seoul (KR); Sunghwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/433,754

(22) Filed: Mar. 29, 2012

(65) Prior Publication Data

US 2013/0039047 A1 Feb. 14, 2013

(30) Foreign Application Priority Data

Aug. 12, 2011 (KR) ..... 10-2011-0080688

(51) Int. Cl.

| | |
|---|---|
| ***F21V 21/00*** | (2006.01) |
| ***F21V 7/00*** | (2006.01) |
| ***F21L 4/02*** | (2006.01) |
| ***F21S 8/04*** | (2006.01) |
| ***F21V 21/04*** | (2006.01) |

(52) U.S. Cl.

CPC ... *F21L 4/02* (2013.01); *F21V 7/00* (2013.01); *F21S 8/04* (2013.01); *F21V 21/04* (2013.01)

USPC ..... 362/235; 362/225; 362/236; 362/217.02; 362/148; 362/249.02; 257/88; 257/89

(58) Field of Classification Search

CPC ..... F21V 1/02; F21V 21/04; F21V 21/048; F21V 21/049; F21V 7/00; F21S 8/02; F21S 8/026; F21S 8/04; F21S 8/046

USPC ..... 362/249.02, 311.02, 545, 227, 236, 362/184, 225, 235, 217.02; 257/88, 89

See application file for complete search history.

(56) References Cited

U.S. PATENT DOCUMENTS

| | | | | |
|---|---|---|---|---|
| 3,291,975 | A * | 12/1966 | McCullough et al. | 362/235 |
| 5,172,504 | A * | 12/1992 | De Maat et al. | 40/605 |
| 5,216,411 | A * | 6/1993 | Ashitomi et al. | 345/168 |
| 6,065,854 | A * | 5/2000 | West et al. | 362/249.06 |
| 6,813,853 | B1 * | 11/2004 | Tucker | 40/448 |
| 6,956,541 | B2 * | 10/2005 | McClintock | 345/1.1 |
| 7,091,933 | B2 * | 8/2006 | McClintock et al. | 345/55 |
| 7,824,073 | B2 * | 11/2010 | Hsieh et al. | 362/249.11 |
| 7,841,740 | B2 * | 11/2010 | Zhou et al. | 362/249.02 |
| 8,136,965 | B2 * | 3/2012 | Pickard et al. | 362/294 |

(Continued)

FOREIGN PATENT DOCUMENTS

| | | | |
|---|---|---|---|
| JP | 2009-272451 | A | 11/2009 |
| JP | 2010-067415 | A | 3/2010 |
| KR | 10-2006-0086494 | A | 8/2006 |

(Continued)

OTHER PUBLICATIONS

Korean Notice of Allowance dated Oct. 15, 2012 issued in Application No. 10-2011-0080688 (with English translation).

*Primary Examiner* — Diane Lee
*Assistant Examiner* — Kenny C Sokolowski
(74) *Attorney, Agent, or Firm* — Ked & Associates, LLP

(57) ABSTRACT

This invention relates to lighting apparatuses, and more particularly to a lighting apparatus in which an LED module is detachably mounted to make replacement and repair easy, and which enables to mount the same to fit to different sizes of spaces by a combination of assembly of a plurality of LED modules.

10 Claims, 11 Drawing Sheets

(56) References Cited

U.S. PATENT DOCUMENTS

| | | | | |
|---|---|---|---|---|
| 8,408,737 | B2 * | 4/2013 | Wright et al. | 362/247 |
| 2011/0026238 | A1 * | 2/2011 | Kim | 362/84 |
| 2011/0286215 | A1 * | 11/2011 | Peng | 362/249.02 |
| 2011/0308124 | A1 * | 12/2011 | Polin | 40/729 |

FOREIGN PATENT DOCUMENTS

| | | | |
|---|---|---|---|
| KR | 10-0931773 | B1 | 12/2009 |
| KR | 10-2010-0017616 | A | 2/2010 |
| KR | 10-0947657 | B1 | 3/2010 |
| KR | 10-0990753 | B1 | 10/2010 |

* cited by examiner (a)

(b)

(a)

(b)

(a)

(b)

(a)

(b)

(a)

(b)

LIGHTING APPARATUS

CROSS REFERENCE TO RELATED APPLICATION

This application claims the benefit of the Patent Korean Application No. 10-2011-0080688, filed on Aug. 12, 2011, which is hereby incorporated by reference as if fully set forth herein.

BACKGROUND OF THE DISCLOSURE

1. Field of the Disclosure

This invention relates to lighting apparatuses, and more particularly to a lighting apparatus in which an LED module is detachably mounted to make replacement and repair easy, and which enables to mount the same to fit to different sizes of spaces by a combination of assembly of a plurality of LED modules.

2. Discussion of the Related Art

In general, a lighting industry has a long history enough to be developed with civilization of mankind, and a very close relation with mankind.

Even today, the lighting industry is kept developing, making a variety of researches on light sources, light emitting systems, driving systems, improvement on efficiency, and so on.

Presently, as major light sources for lighting, incandescent lamps, discharge lamps, and fluorescent lamps are used mostly, in various purposes, such as domestic, landscape and industrial purposes.

Of the light sources, resistant light sources, such as the incandescent lamps have problems of poor efficiency and substantial heat generation, the discharge lamps have problems of a high price and a high voltage, and the fluorescent lamps have an environmental problem caused by mercury.

In order to solve the drawbacks of the light sources, interest in a light emitting diode LED is increasing, which has advantages in efficiency, variety of colors, autonomy of design, and so on.

The light emitting diode is a semiconductor device which emits a light when a voltage is applied thereto in a forward direction, and has a long lifetime, low power consumption, and electric, optical, and physical characteristics suitable for mass production, to replace the incandescent lamps and the fluorescent lamps, rapidly.

In the meantime, of the lighting apparatuses, there is a modular lighting apparatus provided with a plurality of LED modules. In general, the modular lighting apparatus is used for lighting a large space.

However, the modular lighting apparatus has problems in that it is required that all modules are replaced if any one of the modules is out of order, and individual fabrication of the modular lighting apparatus is required to fit to a size of a ceiling space.

SUMMARY OF THE DISCLOSURE

Accordingly, this invention is directed to a lighting apparatus.

An object of this invention is to provide a lighting apparatus in which an LED module is detachably mounted for easy replacement and repair.

Another object of this invention is to provide a lighting apparatus which enables to mount the same to fit to different sizes of spaces by a combination of assembly of a plurality of LED modules.

Another object of this invention is to provide a lighting apparatus which may prevent glare from taking place.

Another object of this invention is to provide a lighting apparatus which enables to reduce a number of components and a production cost, and improve mass production.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a lighting apparatus includes a plurality of LED modules, and a frame having the LED modules arranged thereon, wherein each of the LED modules includes a case, a substrate arranged in the case, an LED light source mounted to the substrate, a reflective member arranged in the case, and a diffusing member detachably mounted to the case, and the frame is square or rectangular, wherein, if the frame is square, an M*M (M>1) number of LED modules are arranged on the frame at fixed intervals, and if the frame is rectangular, an N*K (N≠K) number of LED modules are arranged on the frame at fixed intervals.

And, the frame may be a plate having a plurality of openings, and the case may be provided to the opening such that a light from the LED light source emits through the opening.

And, the case may have a recess shape having a cross sectional area which becomes smaller as the case goes toward a bottom surface thereof on which the substrate is arranged.

And, the case and the frame may be formed as one unit.

And, the diffusing member may be arranged in a space between the LED light source and the opening.

And, the lighting apparatus further may include a power supply unit connected to the LED module, electrically.

And, the power supply unit may have a plurality of connectors, and each of the LED modules may have a terminal for connection to one of the connectors, electrically.

And, the power supply unit may have a connector, and each of the LED modules may have an input terminal and an output terminal such that the input terminal of one of the LED modules is connected to the connector, and the output terminal and the input terminal of two adjacent LED modules are connected together.

And, the power supply unit may be arranged in a space between cases of adjacent two LED modules.

And, the lighting apparatus may further include a bracket for securing the plurality of LED modules to the frame.

And, the frame may include a main frame having an opening and at least one sub frame mounted to the main frame to divide the opening into a plurality of apertures.

And, a size of each aperture may vary according to a mounting position of the at least one sub frame.

And, a size of each of the cases of the LED modules may correspond to the size of each aperture.

And, the at least one sub frame may include at least one horizontal bar and at least one vertical bar.

Alternatively, a lighting apparatus comprises a plurality of LED modules and a frame having the LED modules provided therein, the frame including a main frame having an opening and at least one sub frame mounted to the main frame to divide the opening into a plurality of apertures, wherein each of the LED modules includes a case, a substrate disposed in the case, an LED mounted to the substrate, a reflective member provided in the case, and a diffusing member detachably mounted to the case, and wherein a size of each aperture varies according to a mounting position of the at least one sub frame.

And, a size of each of the cases of the LED modules may correspond to the size of each aperture.

Alternatively, a lighting apparatus comprises a plurality of LED modules and a frame having the LED modules provided therein, wherein each of the LED modules includes a case, a substrate disposed in the case, an LED mounted to the substrate, a reflective member provided in the case, and a diffusing member detachably mounted to the case, and the frame is square or rectangular, wherein if the frame is square, an N*K (N≠K) number of LED modules are provided in the frame at fixed intervals, and if the frame is rectangular, an M*M (M>1) number of LED modules are provided in the frame at fixed intervals.

And, the frame may be a plate having a plurality of openings, and the case is provided to the opening such that a light from the LED emits through the opening.

And, the case may have a recess shape having a cross sectional area which becomes smaller as the case goes toward a bottom surface thereof on which the substrate is positioned.

And, the diffusing member may be disposed in a space between the LED light source and the opening.

It is to be understood that both the foregoing general description and the following detailed description of this invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of this invention, examples of which are illustrated in the accompanying drawings.

Wherever possible, the same reference numbers will be used throughout the drawings to refer to the same or like parts, repetitive description will be omitted, and a size or a shape can be exaggerated, or reduced for convenience of description.

In the meantime, though terms including ordinal number, such as first or second, can be used for describing various elements, the elements are not limited by the terms, and are used only for making one element distinctive from other elements.

Figure 1:
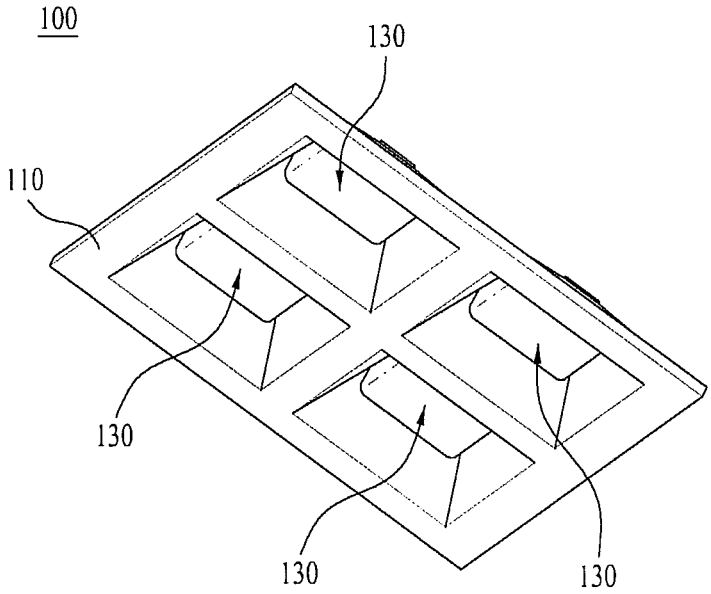
FIGS. 1A and 1B illustrate perspective views each showing a lighting apparatus related to a first preferred embodiment of this invention.
Figure 1:
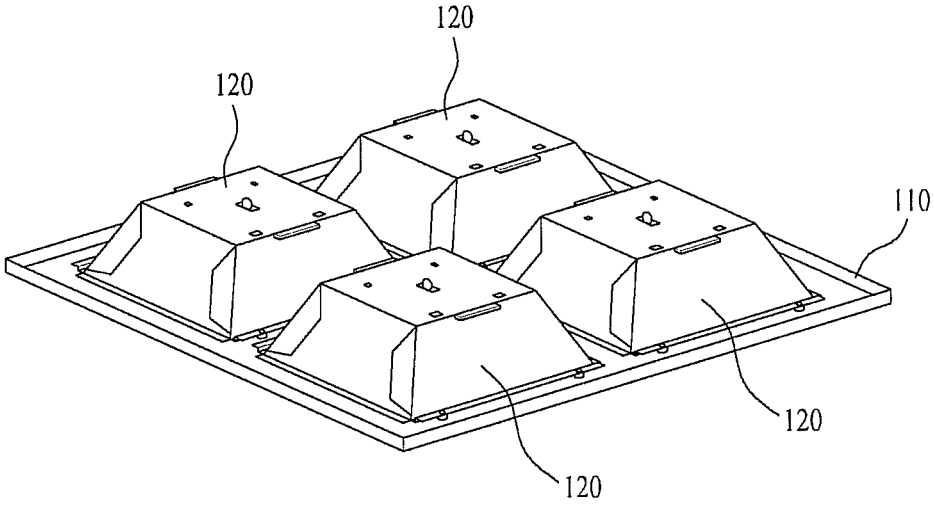
Figure 2:
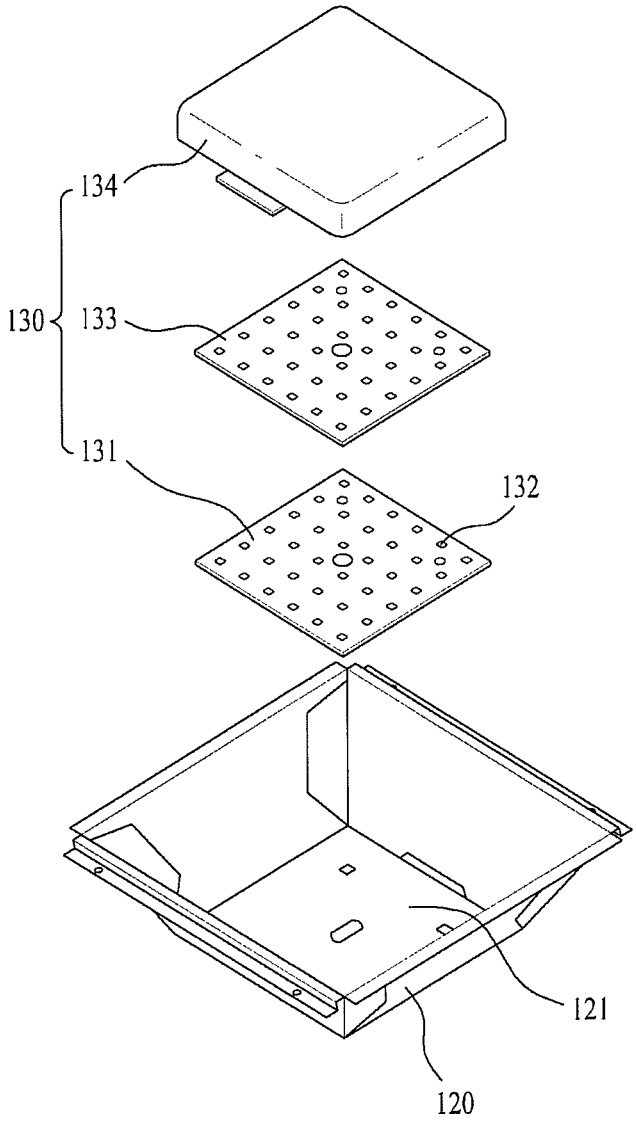
FIG. 2 illustrates an exploded perspective view of an LED module in a lighting apparatus related to this invention.
Figure 3:
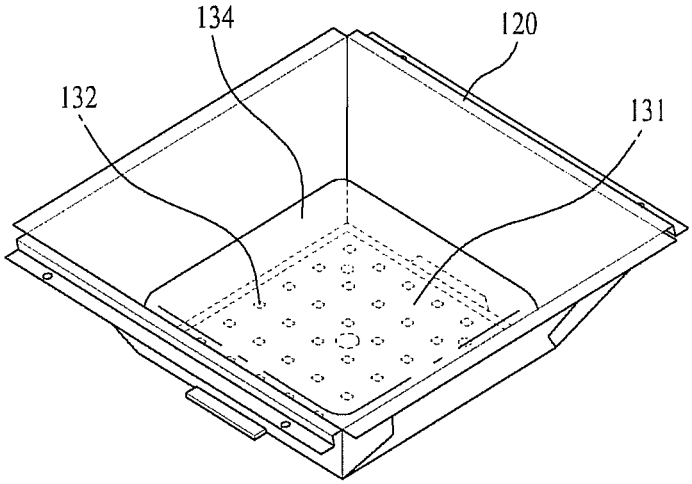
FIG. 3 illustrates a perspective view showing an assembly of the LED module in FIG. 2.

FIGS. 1A and 1B illustrate perspective views each showing a lighting apparatus related to a first preferred embodiment of this invention, FIG. 2 illustrates an exploded perspective view of an LED module in a lighting apparatus related to this invention, and FIG. 3 illustrates a perspective view showing an assembly of the LED module in FIG. 2.

Referring to above drawings, the lighting apparatus 100 includes a plurality of LED modules 130, and a frame 110 having the LED modules 130 mounted thereto, wherein each of the LED module 130 includes a case 120, a substrate 131 arranged in the case 120, an LED light source 132 mounted to the substrate 131, a reflective member 133 arranged in the case 120, and a diffusing member 134 detachably mounted to the case 120.

The frame 110 is square or rectangular. If the frame 110 is square, the frame 110 has an M*M (M>1) number of the LED modules 130 arranged thereto at fixed intervals. And, if the frame 110 is rectangular, the frame 110 has an N*K (N≠K) number of the LED modules 130 arranged thereto at fixed intervals.

The lighting apparatus related to respective embodiments will be described with reference to the attached drawings, in detail.

The lighting apparatus 100 related to a first preferred embodiment of this invention includes a frame 110 and a plurality of LED modules 130 detachably mounted to the frame 110.

And, the frame 110 is a plate having a plurality of openings, and the case may be provided to the opening so that the light from the LED light source 132 emits through the opening.

And, the case 120 may have a recess shape having a cross sectional area which becomes smaller as the recess goes toward a bottom surface 121 thereof having the substrate 131 arranged thereto, and the frame 110 and the case 120 may be formed as one unit.

And, the diffusing member 134 may be arranged in a space between the LED light source 132 and the opening. Hereinafter, the lighting apparatus 100 related to the first embodiment will be described taking a case in which the frame 110 and the case 120 are formed as one unit, and the frame 110 is square as an example. The case 120 may be called as a recess.

Referring to FIGS. 1A, 1B and 2, the frame 110 has a plurality of recesses 120 projected backward arranged at fixed intervals, and the LED module 130 is detachably mounted to the recess 120, and includes the substrate 131, the LEDs 132 mounted to the substrate 131, and the diffusing member 134 covering the LEDs 132.

The frame 110 has a square or rectangular front, and mounted to a ceiling or the like such that the front is exposed to an inside of a lighting space. And, the frame 110 may be formed of metal for effective dissipation of heat from the LED module 130.

The recess 120 may have a shape having a cross sectional area which becomes smaller as the recess 120 goes toward the bottom surface 121 thereof. And, the recess 120 may have a square cross section, and it is preferable that the recess 120 is formed of a material having high reflectivity for the light from the LED 132, not to emit to an inside of the ceiling transmitting through the recess 120, but to emit to the lighting space.

And, by having a structure in which the cross sectional area becomes smaller as the recess 120 goes toward the bottom surface 121 thereof, the recess 120 may prevent the LED module 130 in the recess 120 from exposing to the user directly, thereby improving an exterior quality. And, by arranging the LED light source 132, not as many as a size of the opening in the frame 110, but as many as a size of the bottom surface 121 of the recess, a number of the LED light sources 132 may be reduced.

If the frame 110 has a square cross section, a length of one side of the square may be 300*M (Where M is a natural numeral) mm, and the frame may have $M^2$ (M*M) recesses 120 arranged at fixed intervals spaced from one another. For an example, if the frame 110 has the cross section of 300 mm*300 mm (M=1) to fit to a mounting space in the ceiling, the frame may have one recess having the LED module 130 mounted thereto.

And, if the frame 110 has the cross section of 600 mm*600 mm (M=2), the frame 110 may have four recesses 120 provided therein, each with the LED module 130 detachably mounted thereto.

Accordingly, by selecting the frame 110 fit to a size of the mounting space, and mounting the LED module 130 in the recess 120 in the frame 110, the lighting apparatus 100 of the embodiment enables to deal with different sizes of the mounting space easily, to have a simple fabrication process, and to reduce production cost.

Moreover, in a case any one of the LED modules 130 is out of order or faulty too, since the LED module 130 having a problem may only be replaced without replacing a whole lighting apparatus 100 newly, the lighting apparatus 100 of the embodiment has advantages of easy replacement and repair.

Referring to FIGS. 2 and 3, the LED module 130 may further include the reflective member 133 arranged between the LED 132 and the diffusing member 134, such that the light from the LED 132 light source may light a large space in uniform brightness through the diffusing member 134 and the reflective member 133.

And, the diffusing member 134 may be mounted in the recess 120 detachably, by providing projections at edges of the diffusing member 134 and grooves in an inside circumference of the recess 120 for placing the projection therein.

Referring to FIGS. 2 and 3, the diffusing member 134 may be arranged, not on an opened side of the recess 120, but on the bottom side 121 of the recess 120. As the diffusing member 134 of non-transparent material is not exposed to a lighting space side, a quality of an outer appearance of the diffusing member 134 may be enhanced.

The lighting apparatus 100 may include a power supply unit 240 (See FIG. 5) connected to the LED module 130 electrically arranged in a space between two adjacent recesses on a rear of the frame additionally, which will be described later. And, the power supply unit may include at least one of a converter and a control unit. And, a relation of connection between the power supply unit 240 and the LED module will be described with reference to FIG. 8.

Figure 4:
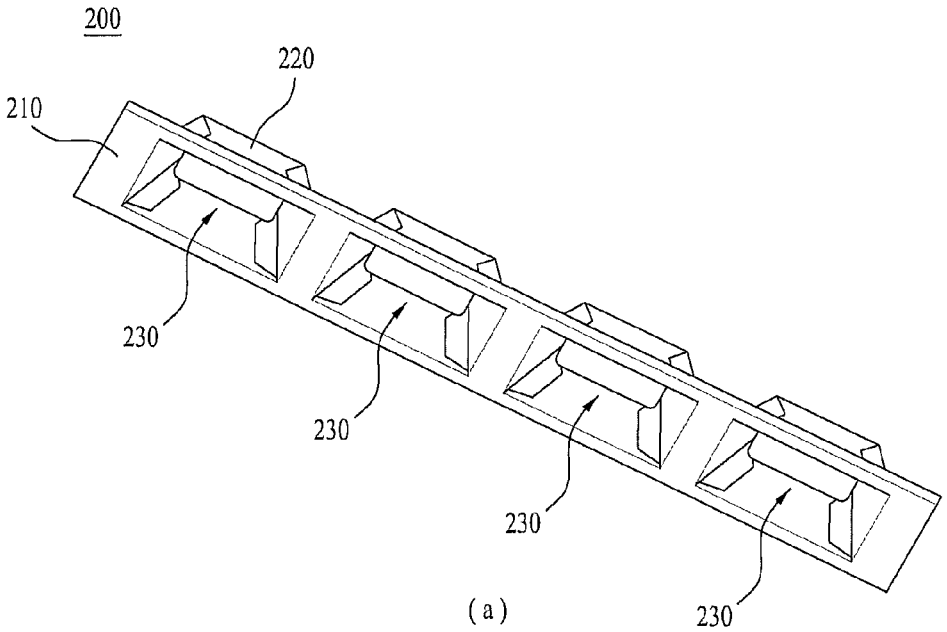
FIGS. 4A, 4B and 5 illustrate perspective views each showing a lighting apparatus related to a second preferred embodiment of this invention.
Figure 4:
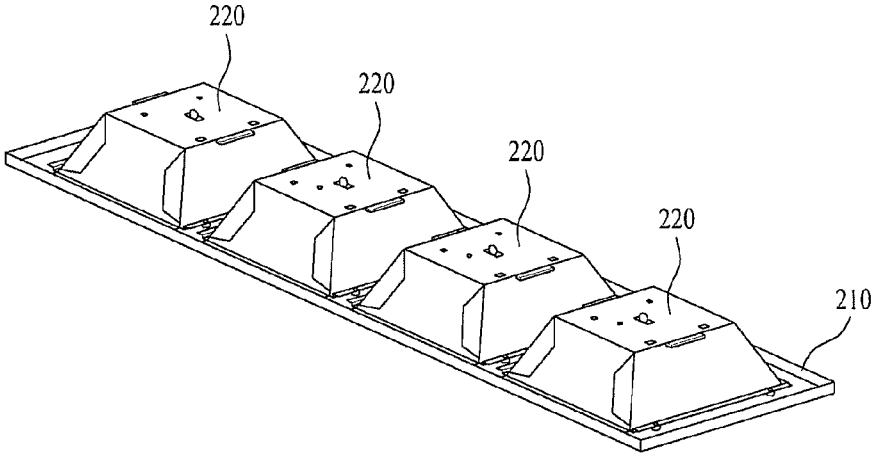
Figure 5:
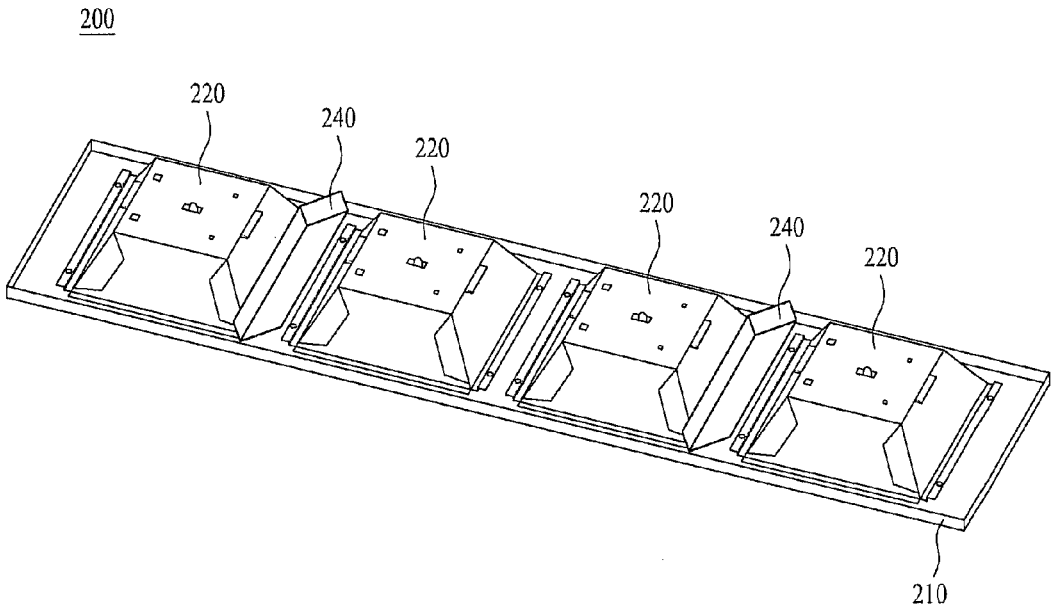

FIGS. 4A, 4B and 5 illustrate perspective views each showing a lighting apparatus related to a second preferred embodiment of this invention, and FIGS. 6A and 6B illustrate front views of lighting apparatuses related to this invention, respectively.

The lighting apparatus 200 related to the embodiment includes a frame 210, and a plurality of LED modules 230 detachably mounted to the frame 210.

In detail, the frame 210 has a plurality of recesses 220 having the LED modules 230 detachably mounted thereto, respectively.

Referring to FIGS. 4 and 5, the frame 210 has a rectangular front, and mounted to a ceiling or the like such that the front is exposed to an inside of a lighting space.

The lighting apparatus 200 of the embodiment has elements identical to the foregoing lighting apparatus 100 except a shape of the frame 210.

If the frame 210 has a rectangular cross section, the rectangle has one side with a length of 300*N (Where N is a natural numeral) mm, and the other side with a length of 300*K (Where K is another natural numeral). For an example, in order to fit to a mounting space in the ceiling, if the frame 210 has a cross section of 300 mm*600 mm (N=1, and K=2), two recesses 220 having the LED modules 230 mounted thereto respectively may be provided to the frame 210.

And, referring to FIGS. 4A and 4B, if the frame 210 has a cross section of 300 mm*1200 mm (N=1, and K=4), four recesses 220 may be provided to the frame 210 in a length direction, and each of the recesses 220 may have the LED module 230 detachably mounted thereto.

Referring to FIG. 5, the lighting apparatus 200 may include a power supply unit 240 (See FIG. 5) connected to the LED module 230 electrically arranged in a space between two adjacent recesses 220 on a rear of the frame 210, additionally. And, the power supply unit 240 may include at least one of a converter and a control unit.

The power supply unit 240 may be provided as many as the LED modules 230, or one power supply unit 240 may be connected to a plurality of LED modules 230.

Since the power supply unit 240 is arranged between to recesses 220, not to require an additional space for mounting the power supply unit 240, space utilization is enhanced, and a thickness of the lighting apparatus 200 may be reduced.

In the meantime, referring to FIG. 6, a size of the lighting apparatus 100 or 200 related to the first or second embodiment may be determined as follows. However, of course, the size of the lighting apparatus 100 or 200 may be determined by methods different from this, depending on standards applicable to the mounting space.

Figure 6:
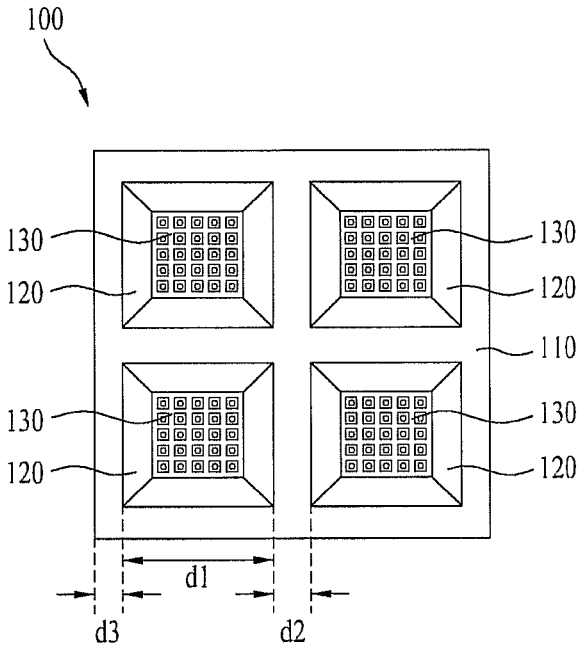
FIGS. 6A and 6B illustrate front views of lighting apparatuses related to this invention, respectively.
Figure 6:
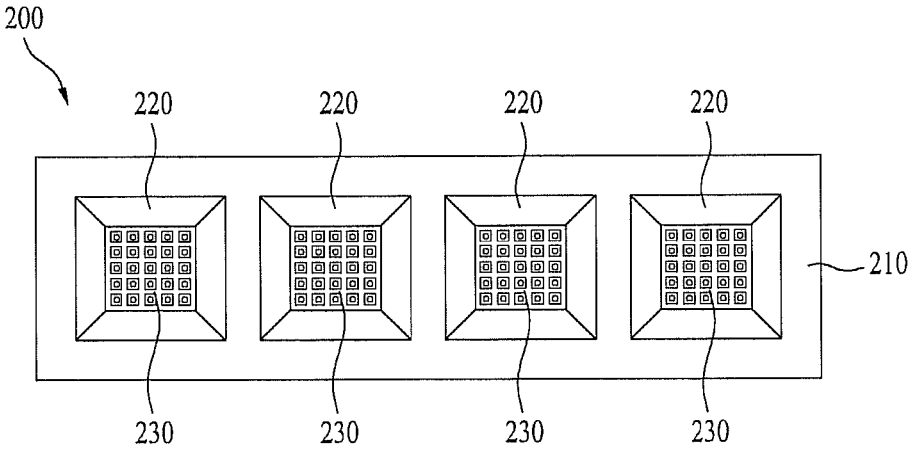

Referring to FIG. 6, if the recess 120 has a square cross section, the recess 120 may have one side length d1 of about 230 mm, a space d2 between two adjacent recesses 120 may be about 33 mm, and a space d3 between the edge of frame 110 and the recess 120 may be about 51.5 mm. And, the space d3 between the edge of frame 110 and the recess 120 may be about 18.5 mm larger than the space d2 between two recesses 120.

Figure 7:
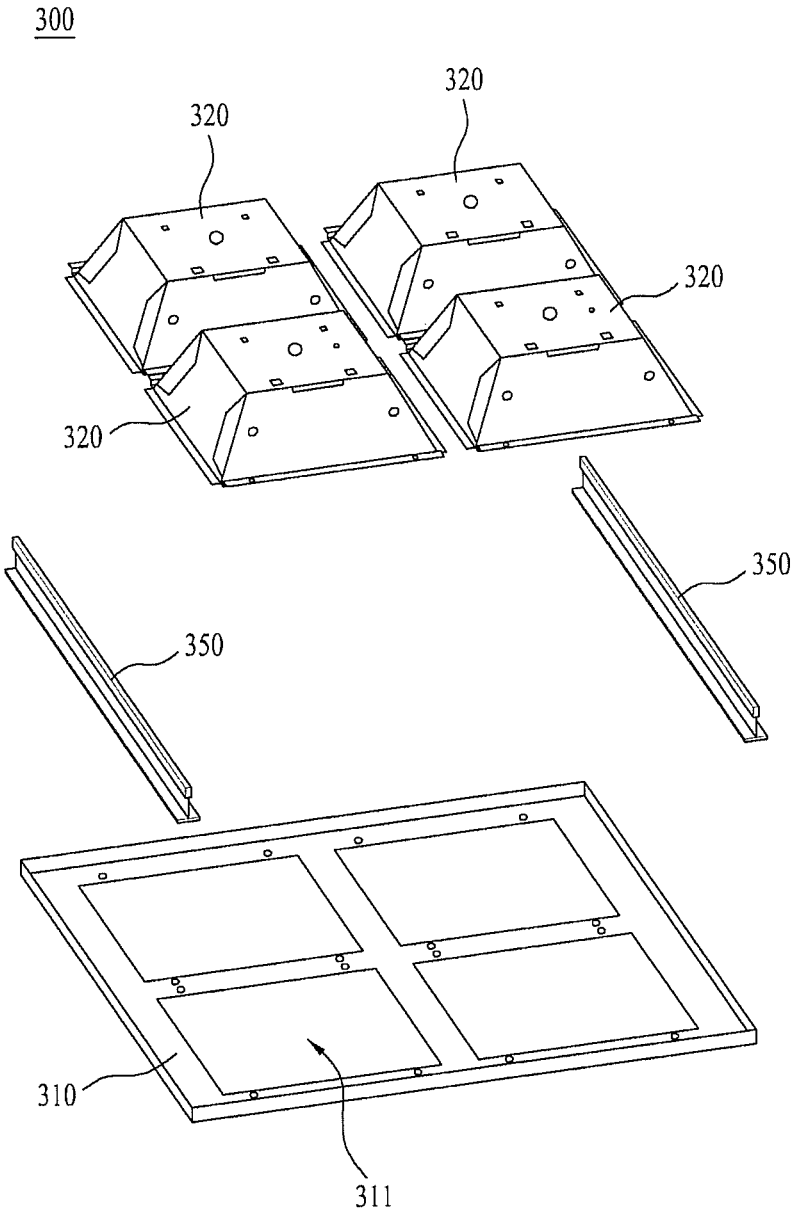
FIG. 7 illustrates an exploded perspective view of a lighting apparatus related to a third preferred embodiment of this invention.

FIG. 7 illustrates an exploded perspective view of a lighting apparatus related to a third preferred embodiment of this invention.

The lighting apparatus 300 related to the third embodiment includes a frame 310 mounted to a wall having a plurality of openings 311, a plurality of cases mounted to the openings 311 placed in the wall, an LED module 320 detachably mounted in the case having a substrate, LEDs mounted to the substrate, and a diffusing member covering the LEDs, and a bracket 350 for securing a plurality of the LED modules 320 to the frame 310.

Since the embodiment is different from the foregoing embodiment only in a structure of the frame while the LED module is identical, detailed description of the LED module will be omitted.

The embodiment may have a unitized LED module 320 including the case.

By selecting the frame 310 fit to a size of the mounting space and mounting the LED module including the case as many as required to the frame 310, the lighting apparatus 300 of the embodiment enables to deal with different sizes of the mounting spaces easily, to have a simple fabrication process, and to reduce production cost.

For an example, if the frame 310 has a cross section of 600 mm*600 mm, four LED modules 320 may be mounted to the frame 310.

If the frame 310 has a cross section of 300 mm*1200 mm, four LED modules 320 may be mounted to the frame 310 in a length direction thereof.

The bracket 350 may have different shapes and structures. As an example, as shown in FIG. 7, the bracket 350 may be mounted to a rear of the frame 310 in a state the bracket 350 receives one longitudinal section of at least two LED modules 320.

Figure 8:
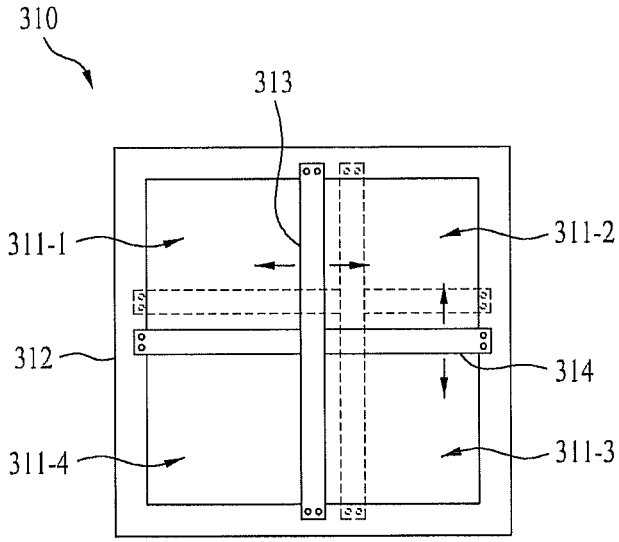
FIG. 8 illustrates a front view of a frame of a lighting apparatus related to this invention.

FIG. 8 illustrates a front view of a frame of a lighting apparatus related to this invention.

Referring to FIGS. 7 and 8, the frame 310 may include a main frame 312 having an opening 311 and at least one sub frame 313 and 314 mounted to the main frame 312 to divide the opening 311 into a plurality of apertures 311-1 to 311-4.

Also, the at least one sub frame 313 and 314 may include at least one horizontal bar 314 and at least one vertical bar 313.

A size of each aperture 311-1 to 311-4 may vary according to a mounting position of the at least one sub frame 313 and 314, and a size of each of the cases of the LED modules 320 may correspond to the size of each aperture 311-1 to 311-4.

The lighting apparatus 300 related to the third embodiment may comprise a plurality of LED modules and a frame having the LED modules provided therein, the frame 310 including a main frame 312 having an opening 311 and at least one sub frame 313 and 314 mounted to the main frame 312 to divide the opening 311 into a plurality of apertures 311-1 to 311-4, wherein each of the LED modules 320 includes a case, a substrate disposed in the case, an LED mounted to the substrate, a reflective member provided in the case, and a diffusing member detachably mounted to the case, and wherein a size of each aperture 311-1 to 311-4 may vary according to a mounting position of the at least one sub frame 313 and 314.

Also, the lighting apparatus may further include a bracket 350 for securing a plurality of the LED modules 320 to the frame 310.

Figure 9:
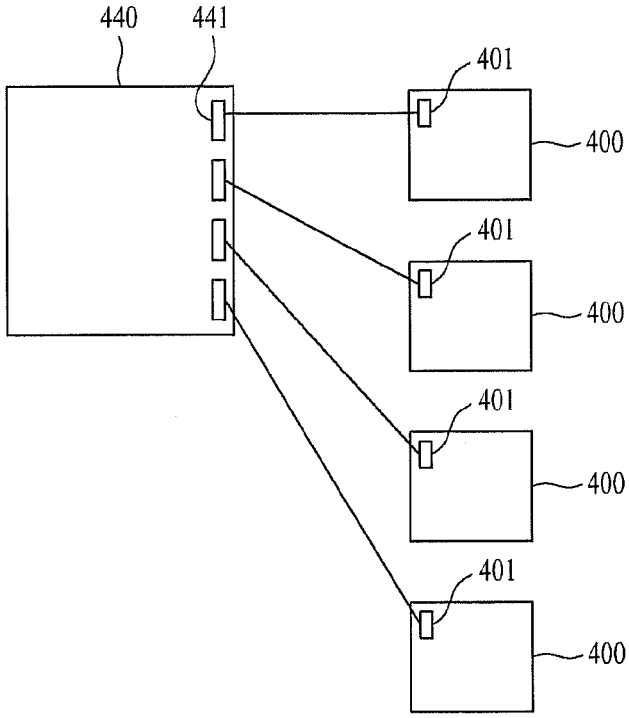
FIGS. 9A and 9B illustrate circuit diagrams of lighting apparatuses related to this invention, respectively.
Figure 9:
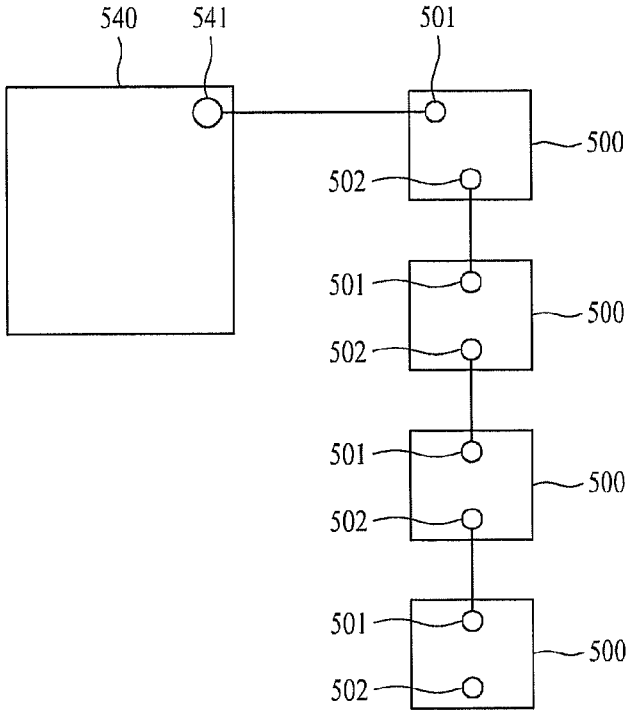

FIGS. 9A and 9B illustrate circuit diagrams of lighting apparatuses related to this invention, respectively.

Referring to FIG. 9A, a power supply unit 440 may have a plurality of connectors 441 provided thereto, and each of the LED modules 400 may have a terminal 401 connected to the connector 441 electrically, such that the LED modules 400 may be connected to the connectors at the power supply unit 440 in one to one fashion.

Different from this, as shown in FIG. 9B, the power supply unit 540 may have a connector 541, and each of the LED modules 500 may have an input terminal 501 and an output terminal 502, such that the input terminal 501 of one of the LED modules 500 may be connected to the connector 541, and the output terminal 502 and the input terminal 501 of adjacent two LED modules 500 may be connected. In this case, the plurality of LED modules 500 can receive power in a state the plurality of LED modules 500 are connected to the power supply unit 540 in series.

And, as described before, the power supply unit 440 or 540 may be arranged between cases of adjacent LED modules for reducing a thickness of a whole lighting apparatus.

As has been described, the lighting apparatus of this invention has the following advantages.

The detachable mounted LED modules permit easy replacement and repair.

The combination of assembly of the plurality of LED modules permits to mount the lighting apparatus to fit to different sizes of spaces.

The lighting apparatus permits to prevent glare, and to reduce a number of components and a production cost.

Figure 10:
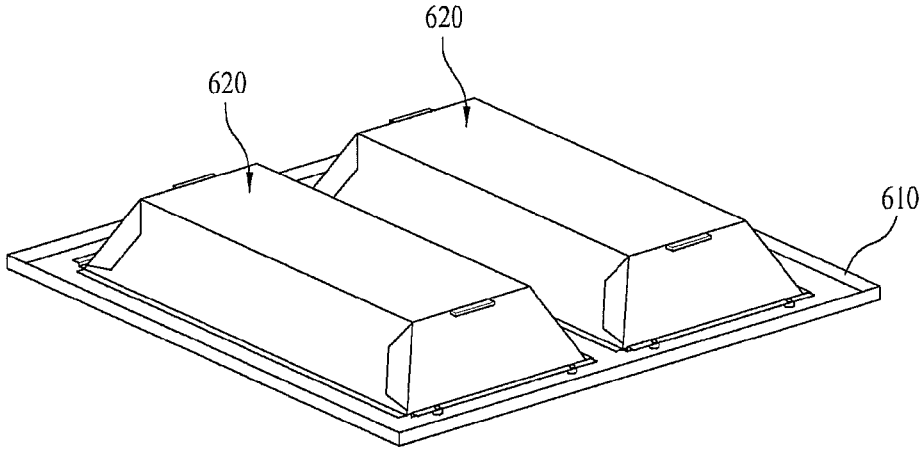
FIG. 10 illustrates perspective views showing a lighting apparatus related to a fourth preferred embodiment of this invention.

FIG. 10 illustrates perspective views showing a lighting apparatus related to a fourth preferred embodiment of this invention, and FIGS. 11A and 11B illustrate front views showing a lighting apparatus related to a fifth preferred embodiment of this invention.

Figure 11:
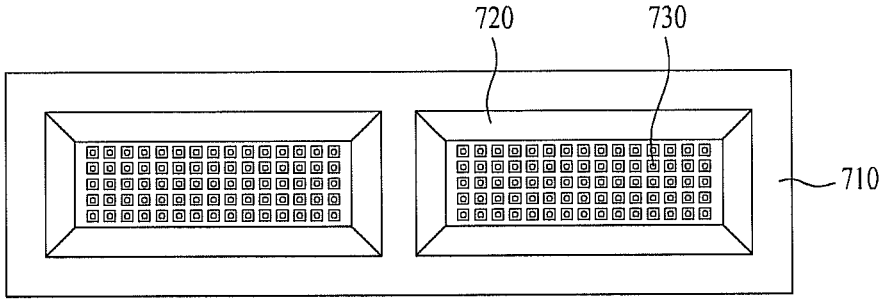
FIGS. 11A and 11B illustrate front views showing a lighting apparatus related to a fifth preferred embodiment of this invention.
Figure 11:
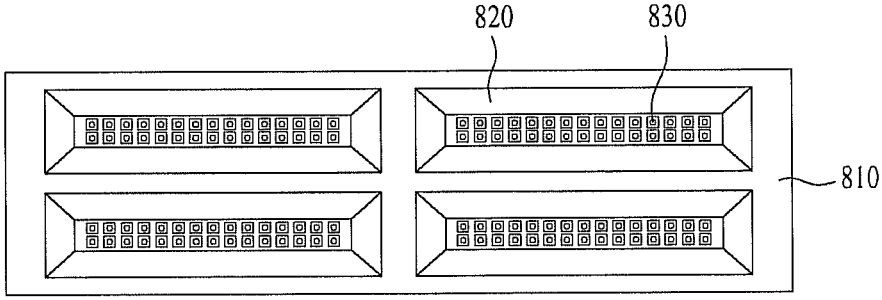

Referring to FIGS. 10 to 11B, a lighting apparatus may comprise a plurality of LED modules 730 and 830 and a frame 610, 710 and 810 having the case 620, 730 and 830 provided therein.

Referring to FIGS. 11A and 11B, each of the LED modules 730 and 830 includes a case 720 and 820, a substrate disposed in the case 720 and 820, an LED mounted to the substrate, a reflective member provided in the case, and a diffusing member detachably mounted to the case 720 and 820, and the frame 710 and 810 is square or rectangular.

Referring to FIG. 10, if the frame 610 is square, an N*K (N=2, K=1) number of LED modules 620 are provided in the frame 610 at fixed intervals.

Alternatively, if the frame 710 and 810 is rectangular, an M*M (M=1 or 2) number of LED modules 730 and 830 are provided in the frame 710 and 810 at fixed intervals.

Also, the frame 610, 710 and 810 may be a plate having a plurality of openings, and the case is provided to the opening such that a light from the LED emits through the opening.

The case may have a recess shape having a cross sectional area which becomes smaller as the case goes toward a bottom surface thereof on which the substrate is positioned as discussed above.

The diffusing member may be disposed in a space between the LED light source and the opening as discussed above.

It will be apparent to those skilled in the art that various modifications and variations can be made in this invention without departing from the spirit or scope of the inventions. Thus, it is intended that this invention covers the modifications and variations of provided they come within the scope of the appended claims and their equivalents.

What is claimed is:

1. A lighting apparatus, comprising:

a plurality of LED modules; and a power supply connected to the plurality of LED modules, electrically; and a frame having the plurality of LED modules provided therein, wherein each of the plurality of LED modules includes a case, a substrate disposed in the case, an LED mounted to the substrate, a reflective member provided in the case, and a diffusing member detachably mounted to the case, and wherein the frame has a prescribed shape, wherein when the frame is square, an M*M (M>1) number of LED modules are provided in the frame at fixed intervals, where M is a natural number, and when the frame is not square, an N*K (N≠K) number of LED modules are provided in the frame at fixed intervals, where N and K are natural numbers, wherein the frame is a plate having a plurality of openings, wherein each case is positioned with respect to one of the plurality of openings such that light from the respective LED is emitted through the respective opening, wherein the case has a recessed shape having a cross sectional area which decreases as the case extends toward a bottom surface thereof on which the substrate is positioned, wherein the diffusing member is disposed in a space between the respective LED and the respective opening, wherein the reflective member is disposed between the respective LED and the respective diffusing member, wherein at least one projection is provided at one or more edges of the diffusing member, wherein at least one groove is provided inside the case for placing the respective projection therein, and wherein a gap between the substrate and the diffusing member is shorter than a gap between the diffusing member and the respective opening of the frame.

2. The lighting apparatus as claimed in claim 1, wherein the case and the frame are formed as one unit.

3. The lighting apparatus as claimed in claim 1, wherein the power supply comprises a plurality of connectors, and each of the plurality of LED modules has a terminal for connection to one of the plurality of connectors, electrically.

4. The lighting apparatus as claimed in claim 1, wherein the power supply comprises a connector, and each of the plurality of LED modules has an input terminal and an output terminal, such that the input terminal of one of the plurality of LED modules is connected to the connector, and the output terminal and the input terminal of two adjacent of the plurality of LED modules are connected together.

5. The lighting apparatus as claimed in claim 1, wherein the power supply is disposed in a space between outer circumferences of cases of two adjacent LED modules of the plurality of LED modules.

6. The lighting apparatus as claimed in claim 1, further comprising a bracket to secure the plurality of LED modules to the frame.

7. The lighting apparatus as claimed in claim 1, wherein the frame further includes:

a main frame having an opening;

at least one sub frame mounted to the main frame to divide the opening into the plurality of openings.

8. The lighting apparatus as claimed in claim 7, wherein a size of each opening varies according to a mounting position of the at least one sub frame.

9. The lighting apparatus as claimed in claim 8, a size of each of the cases of the plurality of LED modules corresponds to the size of each opening.

10. The lighting apparatus as claimed in claim 7, wherein the at least one sub frame includes at least one horizontal bar and at least one vertical bar.

* * * * *